US006152618A

United States Patent [19]

Jensen et al.

[11] Patent Number: 6,152,618

[45] Date of Patent: Nov. 28, 2000

[54] APPARATUS AND A METHOD FOR PROCESSING PHOTOGRAPHIC MATERIAL

[75] Inventors: Tommy Jensen, Roskilde; Finn Hougaard, Copenhagen; Henrik Bockmann Petersen, Næstved, all of Denmark

[73] Assignee: Glunz & Jensen A/S, Ringsted, Denmark

[21] Appl. No.: 09/409,609

[22] Filed: Oct. 1, 1999

Related U.S. Application Data

[63] Continuation-in-part of application No. PCT/DK98/00124, Mar. 26, 1998, abandoned.

[30] Foreign Application Priority Data

Apr. 1, 1997 [DK] Denmark ..... 0374/97

[51] Int. Cl.[7] ..... G03D 3/02; G03D 3/08; G03D 13/04

[52] U.S. Cl. ..... 396/612; 396/636; 396/626

[58] Field of Search ..... 396/612, 617, 396/620, 626, 636

[56] References Cited

U.S. PATENT DOCUMENTS 4,123,769 10/1978 Fernandez et al. .
4,941,008 7/1990 Nakamura .

FOREIGN PATENT DOCUMENTS 0 050 818 5/1982 European Pat. Off. .
0 415 392 3/1991 European Pat. Off. .

*Primary Examiner*—D. Rutledge
*Attorney, Agent, or Firm*—Thomas R. Vigil

[57] ABSTRACT

An apparatus for the processing of photographic material, and in particular for the development of photographically exposed plates intended for printing plates in a printing operation, comprises an upwardly open tank (5) containing a bath of liquid, conveyor means for conveying the plates (2) along a path (4) in which they are descended obliquely down into the bath and withdrawn again, and at least one movable brush (9) for brushing the top face of the plate. According to the invention the brush is enclosed in a downwards open cavity (12) which has its lower edge immersed into the bath and which is evacuated in order that liquid is sucked thereinto. The invention also comprises a washing apparatus and a method for the processing of photographic material.

25 Claims, 1 Drawing Sheet

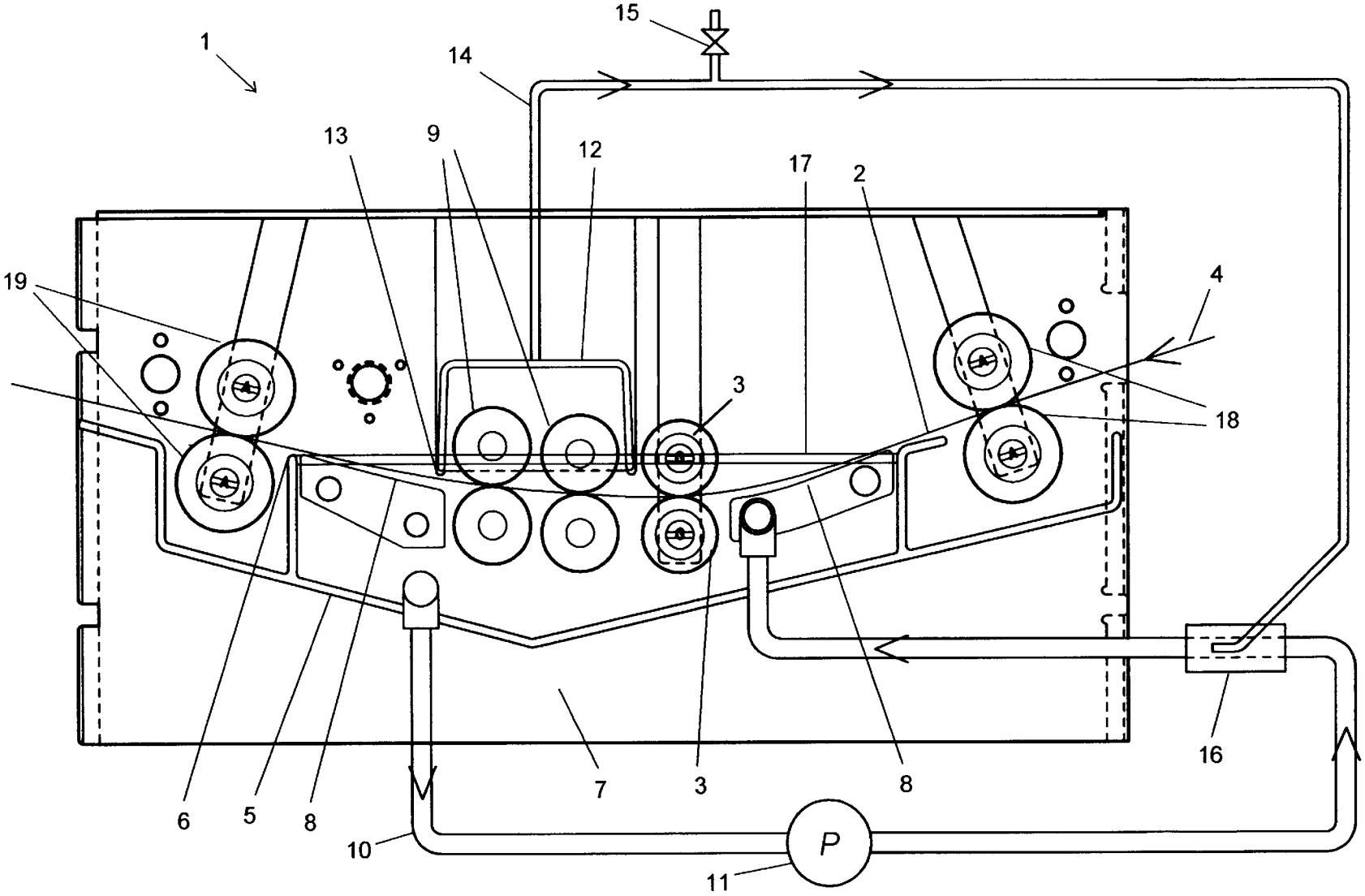
1
2
3
3
4
5
6
7
8
8
9
10
11
12
13
14
15
16
17
18
19
P

APPARATUS AND A METHOD FOR PROCESSING PHOTOGRAPHIC MATERIAL

CROSS REFERENCE TO RELATED APPLICATION

This application is based on patent application Ser. No. 374/97 filed in Denmark on Apr. 1, 1997, the contents of which are incorporated hereinto by reference.

This is a continuation-in-part of International Application PCT/DK98/00124 with an international filing date of Mar. 26, 1998, now abandoned.

BACKGROUND OF THE INVENTION

1. Field of the Invention

The present invention relates to an apparatus and a method for processing photographic material, and in particular to the development of photographically exposed plates in order to prepare them for use as printing plates in a printing operation.

Photographic materials and photographic exposure, respectively, as used herein and in the following refer to all kinds of photographic materials, related materials, and processes, respectively, irrespective of whether they are based on the use of visible light or of another form of radiation as long as they serve to reproduce an image by similar general principles. Sheets herein comprise all flat objects that may be conveyed as a web along a path, e.g. foils, laminates, plates whether in short formats, long formats or continuous webs. The sheets may be flexible or inflexible. The printing operations may be offset printing, flexographic printing, or other. Treatment by liquid may comprise reacting an emulsion on the face with chemicals in order to fix an image, to dissolve or to swell parts of the emulsion in order to clean the surface, or in order to provide the surface with a finishing, etc. as known in the art of photographic image processing.

2. Description of the Prior Art

EP-A 0 410 500 discloses a lithographic printing plate adapted for offset printing in which a pattern is formed in the printing plate by a photographic process. This pattern is formed by coating the plate with a light sensitive emulsion, exposing said emulsion and developing the image of the exposed emulsion. The developing process comprises different baths through which the plate passes successively and which have different purposes, such as fixation of the exposed image, washing off of chemicals, and surface treatment of the finished plate.

EP-A 0 623 854 discloses an apparatus for processing a lithographic offset printing plate in such a process, which apparatus comprises different baths through which the plate is conveyed, controlled by suitable guide rollers. The guide rollers define a conveyor path guiding the plate down into the respective baths and up again, the plate being flexed in order to follow this course.

EP-A 0 415 392 discloses a processing apparatus for processing a printing plate, provided with a bath and guide rollers which control the plate so that it is descended obliquely into the solution in the bath, flexed to follow a curved passage below the solution level and pulled upwardly out of the bath. The apparatus comprises a rotating brush roller, accommodated submerged in the solution, and a floating cover for shielding a portion of the surface of the solution, including the area above the brush. The purpose of the floating cover is to counteract the deterioration of the processing solution by the air.

EP-A 0 050 818 discloses a processing apparatus for printing plates provided with a tank and with conveyor means for guiding the plate down into the bath along a curved passage and up again, which apparatus comprises a rotating brush partially submerged in the bath and adapted for brushing the upper surface of the plate. This prior art apparatus is provided with a protective shield above the rotating brush, the rear edge of said protective shield being disposed completely below the solution level. The purpose of this is to counteract foaming in the processing solution and to counteract deterioration of the processing solution by the air.

EP 0 260 615 discloses a processing apparatus for printing plates, comprising conveyor means for conveying the printing plate along a straight path descending into a bath to exit the bath at a lower portion thereof through the nip between a pair of rollers adapted for holding back the liquid. A rotating, partially submerged brush roller brushes the upper face of the printing plate.

U.S. Pat. No. 4,515,456 discloses a processing apparatus adapted for conveying the plates along a straight path through a bath, wherein sealing of entry and exit ports are provided by supple lip seals forced against the face of the plate.

Brushing generally enhances the processing process, but generally has an adverse effect on the useful life of many developer baths. Many processing chemicals are highly reactive and may exchange different gasses with the air, e.g. absorb $CO_2$ or oxygen which react with chemicals in the baths so that these no longer have the desired effect and therefore must be reactivated or replaced. Movable brushes stirring the surface of the solution strongly accelerate this deterioration process.

For reasons of minimizing handling of the delicate emulsion it is generally favored to design the processing apparatuses for conveying the plates with the emulsion-covered side facing up.

An apparatus provided with brushes for brushing the sheet upper face, which brushes are completely submerged below the solution surface, is limited in its scope of design, which restricts the use and functionality of the apparatus. If the apparatus is to be designed with conveyor means for conveying the plates downwards and deep into the bath and subsequently upwards to exit the bath, and if the bath is not very long, the plate must be flexed by a relatively acute radius of curvature. This strains the plates and causes resistance to the motion. Furthermore, as a result of the small radius of curvature, the distance between the plate and the brush and hence the force of engagement by the brush may vary depending on several factors, among which the size, resilience and thickness of the plate. Due to the delicate nature of the emulsion on the surface to be brushed, the force of engagement by the brush is, however, a very critical parameter, and an apparatus of the above type is therefore not particularly suitable for processing plates of different grades and thickness.

SUMMARY OF THE INVENTION

The invention, in a first aspect, provides an apparatus for the processing of a web of photographic material, in order to prepare sections of said web for use as printing plates in a printing operation, said apparatus comprising tank means adapted for containing a body of liquid, conveyor means adapted for guiding and conveying said web along a conveying path which path comprises in succession an entry section in which said web enters said body of liquid, a treatment section in which said web is treated by being exposed to liquid of said body of liquid, and an exit section in which said web leaves said body of liquid, brush means adapted for brushing a face of said web at a stage located within said treatment section, vessel means defining a downwards open and substantially air tight cavity which extends above and at least partially around said brush means, and evacuation means adapted for being operated to evacuate said cavity defined by said vessel of air so as to create a subatmospheric pressure within at least part of said cavity.

In this apparatus liquid is sucked into a cavity, which cavity is arranged to extend above and at least partially around the brush means. The level of liquid inside the cavity is raised, thereby partially or completely submerging the brush means with the result of reducing foaming and deterioration effects of the liquid caused by the operation of the brush means.

Application of the invention to an apparatus with a conveying path curving down through a bath has the advantage that the conveying path may be designed for a quite shallow submersion of the plate, corresponding to a very large radius of curvature, avoiding the disadvantages referred to above.

Application of the invention to an apparatus designed for a straight passage of the sheet through a bath has the advantage that the apparatus may be designed for a lower pressure differential across any seal means at entry and/or exit ports.

According to a preferred embodiment the lower edge of the vessel dips into the bath liquid in order that the evacuation will suck liquid into the cavity from the stock in the tank. This will cause the level of liquid prevailing in the tank to drop, unless the stock of liquid is made up by other means. However, it is no problem to provide a bath with a surface area sufficient to ensure that the drop in the level of liquid in the tank becomes quite insignificant.

According to a preferred embodiment the apparatus comprises a pair of movable brushes, one of the brushes being arranged above and the other below the conveying path. This allows one and the same apparatus to process plates exposed on one face or plates exposed on both faces.

According to a preferred embodiment the evacuation means comprises a powered pump, associated with a discharge conduit communicated to the tank. This simplifies control and ensures an advantageous exchange of liquid in the cavity with liquid in the tank.

According to a preferred embodiment the pump is communicated to the cavity by way of a suction conduit provided with an aeration valve. This valve may be operated expediently in connection with maintenance works, thus allowing air to enter the cavity so that the level of liquid there may drop in a controlled manner as may be preferred before removal or opening of the vessel for maintenance works.

The conveyor means may comprise at least one guide roller which is at least partially submerged in the solution bath. The guide roller may be arranged within the cavity or outside the cavity. The guide roller controls the course followed by the sheet, i.e. the flexing of the sheet, relieving the brushes or the brush roller of this function, by which a more accurate control of the point of engagement of the brushes can be obtained.

The invention, in a second aspect, provides a washing apparatus for the washing and brushing of an upper face of a web of photographic material, comprising brush means adapted for brushing an upper face of said web, vessel means defining a downwards open and substantially air tight cavity which extends above and at least partially around said brush means, and evacuation means communicated with said vessel means and adapted for being operated to evacuate said cavity defined by said vessel of air so as to create a subatmospheric pressure within at least part of said cavity.

In this washing apparatus, liquid may be sucked into a cavity, which cavity is arranged to extend above and at least partially around the brush means. The level of liquid inside the cavity is raised, thereby partially or completely submerging the brush means with the result of reducing foaming and deterioration effects of the liquid caused by the operation of the brush means.

The invention, in a third aspect, provides a method for the processing of a web of photographic material, in order to prepare sections of said web for use as printing plates in a printing operation, which method comprises conveying said web along a conveying path which path comprises in succession an entry section in which said web enters a body of liquid, a treatment section in which said web is treated by being exposed to liquid of the body of liquid, and an exit section in which said web leaves the body of liquid, operating brush means to brush a face of said web while said face is exposed to said liquid, enclosing said brush means within a downwards open and substantially air tight cavity which extends above and at least partially around said brush means, and evacuating said cavity so as to create a subatmospheric pressure within said cavity.

Further expedient embodiments of the invention will appear from the sub-claims.

BRIEF DESCRIPTION OF THE DRAWING

The invention will appear from the following description of a preferred embodiment which is given with reference to the drawing which in FIG. 1 shows a schematic diagram of an apparatus adapted for processing photographic material.

The drawing is schematical and not necessarily to scale, and it is simplified so as to merely schematically represent significant elements, whereas other elements which may be suggested by those skilled in the art have been omitted for the sake of clarity.

DESCRIPTION OF THE PREFERRED EMBODIMENTS

The figure shows a processing apparatus designated as a whole with the reference numeral 1. The apparatus essentially comprises tank means, in this embodiment a tank 5 with an upper edge 6, which tank is adapted for holding a stock of processing liquid 7 up to the level of the surface 17. The tank is provided with a circulation conduit 10 operatively associated with a circulation pump 11 for circulating the liquid.

The tank is provided with brush means, in this embodiment two pairs of brush rollers 9, for brushing the top face and the bottom face of the plate. The brush rollers are provided with drive means (not shown) for rotation.

The tank is further provided with conveyor means, in this embodiment two deflector plates 8, a pair of inlet guide rollers 18 outside the edges of the tank, a pair of guide rollers 3 inside the tank and a pair of outlet guide rollers 19 outside another edge of the tank. These components define a conveyor path 4 for a photographic plate 2. The guide rollers are powered by controlled drive means (not shown) in order that plates may be conveyed along the conveyor path in a controlled fashion. Suitable drive means may be suggested by those skilled in the art.

The conveyor path is so adapted that in the area adjacent the guide rollers 3 it curves upwardly by a radius of curvature of 225 mm, which is considered to represent a mild curving, imparting but a gentle strain onto the plates. However, in the area adjacent the brush rollers the conveyor path curves upwardly by an even longer radius of curvature of 1200 mm. With this longer radius of curvature the effect of any variations in the plate resilience and thickness will have but minimal effect on the locus defined by the passage of the plate and will therefore cause but minimal variations in brush engagement pressure. This makes the apparatus well suited for treating a wide variety of plates.

As shown in the figure, in the area by the brush rollers 9, the apparatus comprises vessel means, in this example a generally closed vessel 12 which has a downward opening, the opening being delimited by a lower edge 13. This vessel is positioned in such a manner that the lower edge extends down below the expected normal level of the surface 17 of the processing liquid, whereby to provide a substantially air tight communication between the vessel and the tank. The vessel defines a downwards open cavity 19 generally extending above and around an upper portion of the brush rollers.

The conveyor path is designed for conveying the plates below the cavity lower edges with a suitable clearance.

An upper part of the cavity 19 communicates with evacuation means, in this example a suction conduit 14 connected to an inlet of an evacuation pump 16. The discharge of the evacuation pump merges into a discharge conduit 20, carrying also liquid from the circulation conduit 10 for returning it to the tank. As schematically suggested in the figure the evacuation pump may comprise an ejector pump powered by the flow driven by the circulation pump 11. Other pumps and in particular self-priming liquid pumps may also be used, the only important requirement being that they are capable of transporting both air and liquid at suitable pressure and capacity.

As will be understood from the Figure, the evacuation pump 16 evacuates the cavity 19 at the upper portion of the vessel 12 to below atmospheric pressure. Since the edge 13 dips into the liquid in the tank, the low pressure will suck liquid into the cavity, thereby raising the level of liquid therein. Preferably the pressure differential is sufficient to fill the cavity completely so that the rotating brushes will operate fully submerged in liquid.

In a preferred embodiment adapted for treating plates of widths extending to 1350 mm, it is estimated that a cavity having a cubic content of 5.0 liters will be sufficient for containing the upper portions of two pairs of rotating brushes of a diameter of 55 mm. Given a bath length of 432 mm and a bath width of 1470 mm, the surface area may be computed as 6350 $cm^2$. The vessel covers but a small proportion of this bath area.

On these conditions the drawing of 5.0 liters of liquid into the cavity will cause the level of liquid in the ambient portion of the bath to drop by about 8 mm. Consequently the vessel should be arranged with the lower edge of the vessel dipping into the liquid to a level at least 8 mm below the level of the liquid which prevails prior to evacuation of the cavity in order that the cavity may be filled without having to make up the bath liquid.

The Figure further shows the aeration valve 15 arranged on the suction conduit 14. This valve may selectively be manipulated to allow air to be introduced into the conduit for equalization of the pressures in order that the liquid in the cavity drains to the level of the bath. This is expedient because it provides a facility for emptying the cavity in a controlled manner as may be desired for maintenance work purposes, etc.

The embodiment of the Figure shows the guide rollers 3 placed outside the cavity. In other embodiments the guide rollers may be arranged inside the cavity.

In the embodiment of the Figure brush rollers are provided at the top face as well as the bottom face of the plate. This provides the apparatus with the capacity of processing plates with photographic emulsion on one side just as effectively as plates with photographic emulsion on both sides. Other embodiments may employ oscillating brushes as an alternative or as a supplement to rotating brushes.

Although specific embodiments have been described above it is emphasized that the invention may be exercised in several ways and that the explanation given above exclusively serves to clarify the invention and not to limit the scope of protection conferred, which is exclusively defined by the appended claims.

We claim:

1. An apparatus for the processing of a web of photographic material, in order to prepare sections of said web for use as printing plates in a printing operation, said apparatus comprising:

tank means adapted for containing a body of liquid, conveyor means adapted for guiding and conveying said web along a conveying path which path comprises in succession an entry section in which said web enters said body of liquid, a treatment section in which said web is treated by being exposed to liquid of said body of liquid, and an exit section in which said web leaves said body of liquid, brush means adapted for brushing a face of said web at a stage located within said treatment section, vessel means defining a downwards open and substantially air tight cavity which extends above and at least partially around said brush means, and evacuation means adapted for being operated to evacuate said cavity defined by said vessel of air so as to create a subatmospheric pressure within at least part of said cavity.

2. The apparatus according to claim 1, wherein said tank is upwardly open and adapted for holding a bath of liquid, wherein said entry section comprises a leg for descending said web into said bath, said treatment section comprises an upwardly curved leg and said exit section comprises a leg for withdrawing said web from said bath.

3. The apparatus according to claim 1, wherein said vessel comprises a lower edge and wherein said vessel is arranged with said lower edge located below the expected surface level of bath liquid, in order that the operation of said evacuation means will have the effect of sucking liquid from said tank into said cavity and raising the level of liquid within said cavity.

4. The apparatus according to claim 1, wherein said brush means is adapted for brushing an upper face of said web, and wherein said cavity is adapted for holding a body of liquid within which said brushing means is fully submerged.

5. The apparatus according to claim 1, wherein said evacuation means comprises a powered pump associated with a discharge conduit communicated to said tank.

6. The apparatus according to claim 5, wherein said pump is associated with a suction conduit communicated with said cavity, and wherein said suction conduit is provided with an aeration valve, which may be operated to selectively permit the equalization of the pressure within said suction conduit with the ambient pressure.

7. The apparatus according to claim 1, wherein said brush means comprises a rotating brush roller.

8. The apparatus according to claim 1, wherein said brush means comprises an oscillating brush.

9. The apparatus according to claim 1, wherein said brush means comprises a pair of movable brushes, a first brush arranged above said conveying path, and a second brush arranged below said conveying path.

10. The apparatus according to claim 1, wherein said conveyor means comprises deflector plates, a pair of inlet guide rollers, a pair of guide rollers inside the tank and a pair of outlet guide rollers.

11. A washing apparatus for the washing and brushing of an upper face of a web of photographic material, comprising brush means adapted for brushing an upper face of said web, vessel means defining a downwards open and substantially air tight cavity which extends above and at least partially around said brush means, and evacuation means communicated with said vessel means and adapted for being operated to evacuate said cavity defined by said vessel of air so as to create a subatmospheric pressure within at least part of said cavity.

12. The washing apparatus according to claim 11, wherein said cavity is adapted for holding a body of liquid within which said brushing means is fully submerged.

13. The apparatus according to claim 11, wherein said evacuation means comprises a powered pump associated with a discharge conduit.

14. The washing apparatus according to claim 13, wherein said powered pump comprises an ejector pump capable of transporting both air and liquid.

15. The washing apparatus according to claim 13, wherein said pump is associated with a suction conduit communicated with said cavity, and wherein said suction conduit is provided with an aeration valve, which may be operated to selectively permit the equalization of the pressure within said suction conduit with the ambient pressure.

16. The apparatus according to claim 11, wherein said brush means comprises a rotating brush roller.

17. The apparatus according to claim 11, wherein said brush means comprises an oscillating brush.

18. The washing apparatus according to claim 11, wherein said brush means comprises a pair of movable brushes, a first brush arranged above said conveying path, and a second brush arranged below said conveying path.

19. A method for the processing of a web of photographic material, in order to prepare sections of said web for use as printing plates in a printing operation, which method comprises:

conveying said web along a conveying path which path comprises in succession an entry section in which said web enters a body of liquid, a treatment section in which said web is treated by being exposed to liquid of the body of liquid, and an exit section in which said web leaves the body of liquid, operating brush means to brush a face of said web while said face is exposed to said liquid, enclosing said brush means within a downwards open and substantially air tight cavity which extends above and at least partially around said brush means, and evacuating said cavity so as to create a subatmospheric pressure within said cavity.

20. The method according to claim 19, comprising the steps of providing a tank means containing a bath of said liquid, entering said web into said body of liquid by descending it into said liquid, treating said web with said liquid while conveying it along an upwards curved path, exiting said web from said bath of liquid by conveying said web upwards to withdraw it.

21. The method according to claim 19, comprising the step of providing a substantially air tight communication between said cavity and said tank in order that evacuating said cavity of air will have the effect of sucking liquid from said tank into said cavity and raising the level of liquid within said cavity.

22. The method according to claim 21, comprising the steps of raising the level of liquid to fully submerge said brush means and brushing an upper face of said web.

23. The method according to claim 19, comprising the step of returning to said body of liquid any fluid withdrawn during said step of evacuating said cavity.

24. The method according to claim 19, wherein the step of brushing is effected by means of a rotating brush roller.

25. The method according to claim 19, wherein the step of brushing is effected by means of an oscillating brush.

* * * * *